US008657109B2

(12) United States Patent
Ouzts et al.

(10) Patent No.: US 8,657,109 B2
(45) Date of Patent: Feb. 25, 2014

(54) PACKAGING FOR BEVERAGE CONTAINERS OF DIFFERENT SIZES

(75) Inventors: Denton Ouzts, Ninety Six, SC (US); Michael Lane Polk, Mint Hill, NC (US)

(73) Assignee: Fujifilm North America Corporation, Valhalla, NY (US)

( * ) Notice: Subject to any disclaimer, the term of this patent is extended or adjusted under 35 U.S.C. 154(b) by 223 days.

(21) Appl. No.: 13/197,601

(22) Filed: Aug. 3, 2011

(65) Prior Publication Data

US 2013/0032498 A1 Feb. 7, 2013

(51) Int. Cl.
*B65D 77/00* (2006.01)

(52) U.S. Cl.
USPC ..... 206/217; 206/523; 220/740

(58) Field of Classification Search
USPC ..... 206/217, 426, 446, 521, 523, 541–549, 206/591; 220/737, 739, 740–742, 4.21, 220/4.24, 4.25
See application file for complete search history.

(56) References Cited

U.S. PATENT DOCUMENTS

| | | | | | |
|---|---|---|---|---|---|
| 1,659,315 | A | | 2/1928 | Dailey | |
| 3,216,561 | A | * | 11/1965 | Knapp et al. | 206/523 |
| 4,093,103 | A | * | 6/1978 | Mumford | 220/283 |
| 4,114,761 | A | * | 9/1978 | Kleiner | 206/591 |
| D276,702 | S | | 12/1984 | Entenmann | |
| 4,699,282 | A | * | 10/1987 | Farrar | 206/523 |
| 5,071,002 | A | | 12/1991 | Bradley | |
| D358,767 | S | | 5/1995 | Berggren | |
| D377,901 | S | | 2/1997 | Payne et al. | |
| 5,628,441 | A | | 5/1997 | Dykstra | |
| D381,394 | S | | 7/1997 | Lex, Jr. et al. | |
| 5,729,955 | A | | 3/1998 | Yamada | |
| D402,560 | S | | 12/1998 | Fogle | |
| 5,887,709 | A | * | 3/1999 | Thompson | 206/217 |
| 6,036,007 | A | * | 3/2000 | Alejandro et al. | 206/303 |
| 6,123,307 | A | | 9/2000 | Bain | |
| 6,230,895 | B1 | * | 5/2001 | Laube | 206/710 |
| 6,942,267 | B1 | | 9/2005 | Sturt | |
| 6,943,331 | B2 | * | 9/2005 | Lee | 206/217 |
| 7,055,712 | B2 | * | 6/2006 | Tang | 220/4.21 |
| D531,499 | S | | 11/2006 | Zaidman | |
| 7,198,151 | B1 | * | 4/2007 | Fomby | 206/403 |
| D556,567 | S | * | 12/2007 | Templeton | D9/425 |
| D572,588 | S | | 7/2008 | Osborn et al. | |
| D605,036 | S | | 12/2009 | Lloyd | |
| 7,731,144 | B2 | | 6/2010 | Kazyaka | |
| 7,743,922 | B2 | * | 6/2010 | Pitt | 206/521 |
| 7,789,239 | B2 | * | 9/2010 | Juliano | 206/592 |
| D628,485 | S | | 12/2010 | Golota et al. | |
| 7,874,440 | B2 | * | 1/2011 | Gnepper | 215/222 |
| D649,460 | S | | 11/2011 | Davis | |
| 2002/0096517 | A1 | | 7/2002 | Gelardi | |
| 2007/0023303 | A1 | * | 2/2007 | Templeton | 206/318 |

* cited by examiner

*Primary Examiner* — Luan K Bui
(74) *Attorney, Agent, or Firm* — Blakely, Sokoloff, Taylor & Zafman LLP

(57) ABSTRACT

Universal packaging for beverage containers of different sizes is described. The universal packaging includes a bottom support structure including an opening having an interior floor surface. A raised cylinder extends upwards from the interior floor surface. A beverage container of a first height fits within the opening in the bottom support by placing an open side of the beverage container down upon the interior floor surface, the raised cylinder extending into an interior of the beverage container of the first height. A beverage container of a second height, the second height being less than the first height, fits within the opening in the bottom support by placing a solid bottom surface of the beverage container of the second height down upon an upper surface of the raised cylinder.

10 Claims, 10 Drawing Sheets

PACKAGING FOR BEVERAGE CONTAINERS OF DIFFERENT SIZES

FIELD

Embodiments of the present invention relate generally to the field of packaging materials for shipping beverage containers.

BACKGROUND

Packaging for beverage containers of different sizes, e.g., 11 ounce mugs and 15 ounce mugs, has historically required two different sizes of packaging to accommodate each size of beverage container. The use of two different types of packaging, as compared to using a single universal packaging as described herein, results in higher costs in creating the packaging, additional time in working with different materials to pack the beverage containers, and the burden of managing the storage of the two different sizes of packaging.

SUMMARY

Universal packaging for beverage containers of different sizes is described. The universal packaging includes a bottom support structure including an opening having an interior floor surface, the interior floor surface having a first diameter. A raised cylinder extends upwards from the interior floor surface, the raised cylinder having a base of a second diameter that is less than the first diameter. A beverage container of a first height fits within the opening in the bottom support by placing an open side of the beverage container down upon the interior floor surface, the raised cylinder extending into an interior of the beverage container of the first height. A beverage container of a second height, the second height being less than the first height, fits within the opening in the bottom support by placing a solid bottom surface of the beverage container of the second height down upon an upper surface of the raised cylinder.

Other features and advantages of embodiments of the present invention will be apparent from the accompanying drawings and from the detailed description that follows.

BRIEF DESCRIPTION OF THE DRAWINGS

Embodiments of the present invention are illustrated by way of example and not limitation in the figures of the accompanying drawings, in which like references indicate similar elements, and in which.

DETAILED DESCRIPTION

Universal packaging for beverage containers of different sizes is described. In one embodiment, a beverage container of a first height is a 15 oz. mug and a beverage container of a second height is an 11 oz. mug. Alternatively, one or both beverage containers are a mug, a cup, glass, vase, or another vessel of a similar shape (collectively referred to herein as a beverage container). In one embodiment, the beverage container of the first height is of a greater height than the beverage container of the second height while the beverage containers are of different sizes than 15 oz. and 11 oz., respectively.

Figure 1:
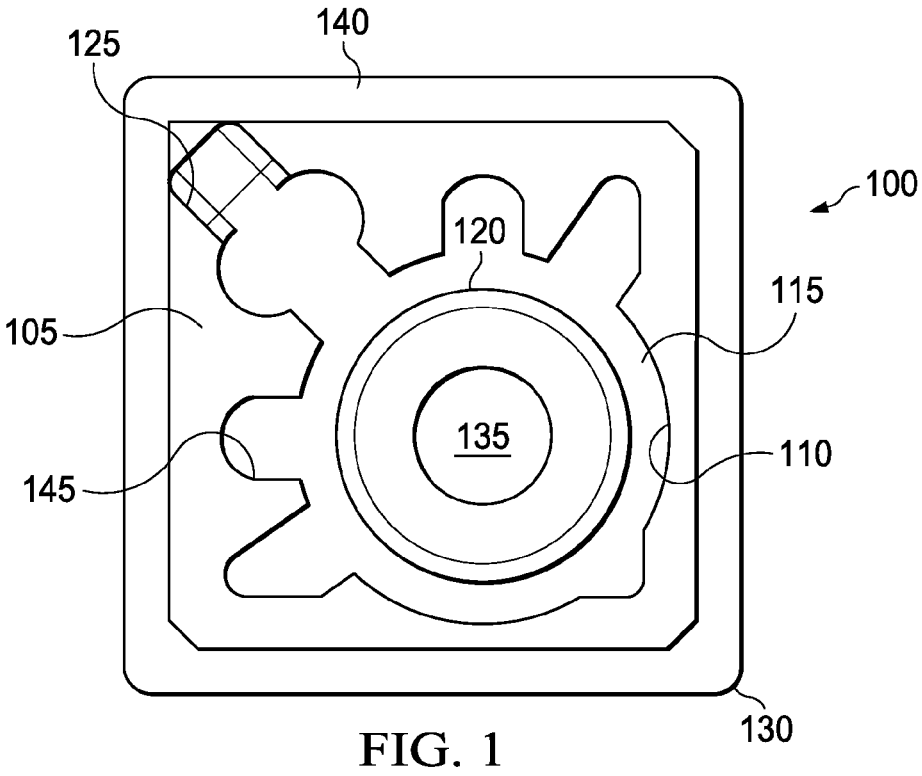
FIG. 1 shows a top view of a bottom support structure of packaging according to one embodiment.
Figure 2:
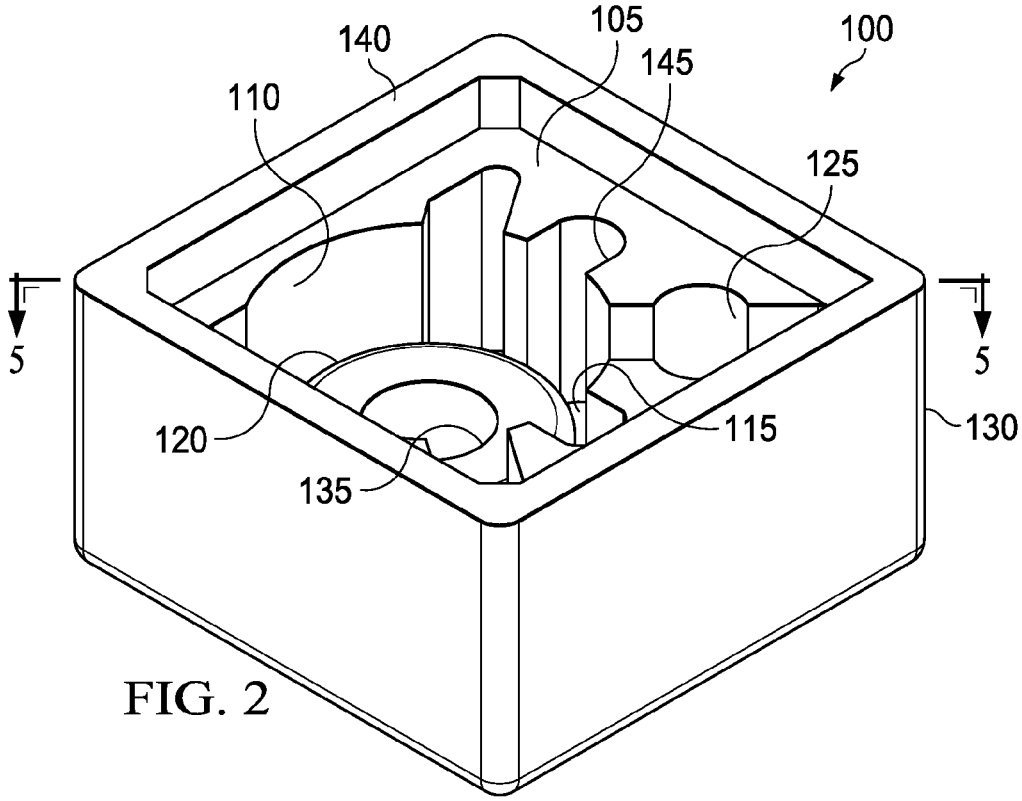
FIG. 2 shows a top and a side isometric view a bottom support structure of packaging according to one embodiment.
Figure 3:
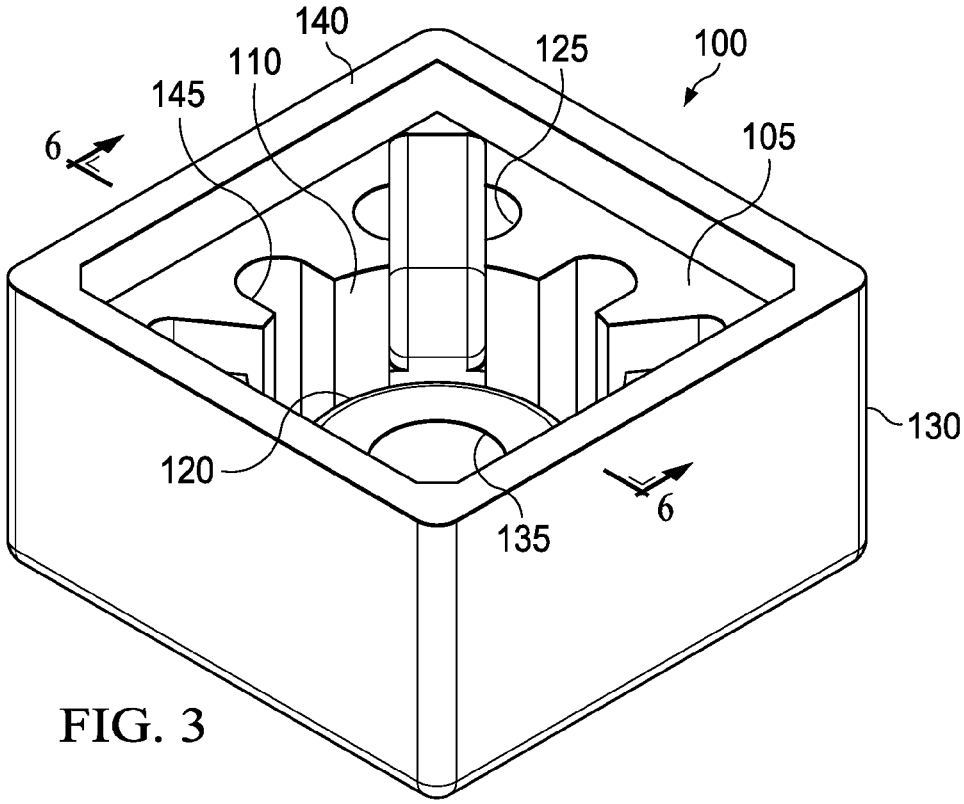
FIG. 3 shows a top and a side isometric view a bottom support structure of packaging according to one embodiment.
Figure 4:
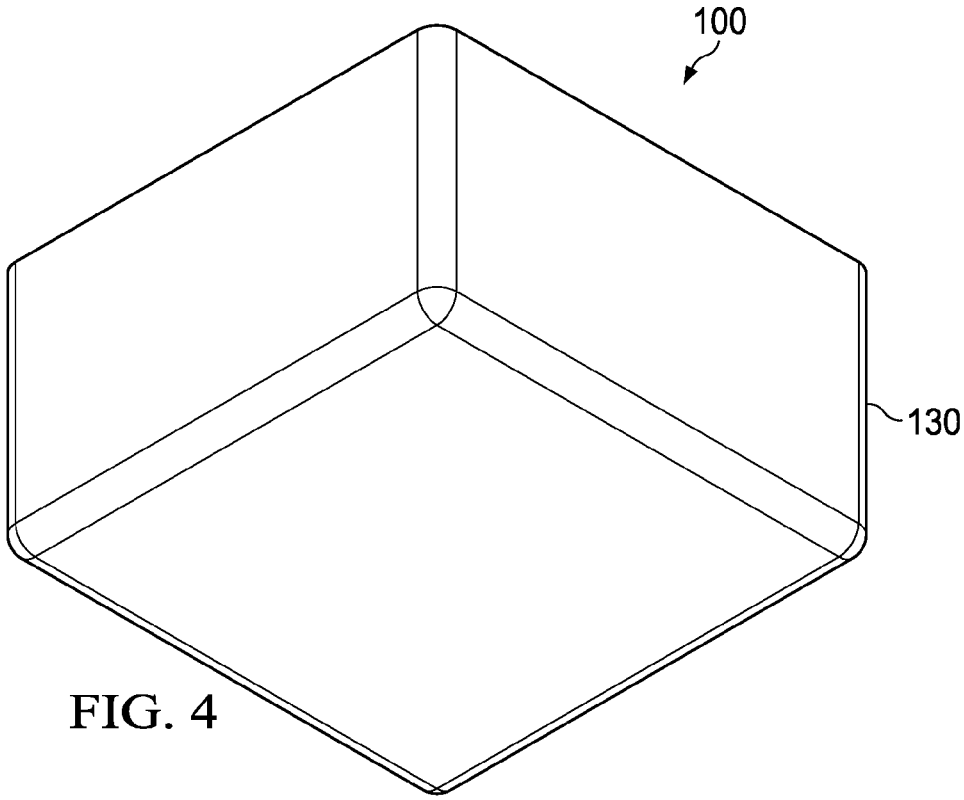
FIG. 4 shows a bottom and a side isometric view a bottom support structure of packaging according to one embodiment.

FIG. 1 illustrates a top view of an exemplary bottom support structure 100 of the universal packaging. FIGS. 2 and 3 illustrate top and side isometric views of the exemplary bottom support structure 100 of the universal packaging. FIG. 4 illustrates a bottom and a side isometric view of the exemplary bottom support structure 100.

In one embodiment, the bottom support structure 100 is a rectangular cuboid. As used herein, a cuboid refers to a structure bounded by six faces in which opposite faces are equal in size. In one embodiment, the cuboid is a square cuboid—i.e., at least two faces are square in shape. In one embodiment the top and bottom faces are square in shape. In one embodiment the sides of the squares that make up the top and bottom faces are between 130 and 140 millimeters in length, e.g., 136 millimeters in length. In one embodiment, the cuboid is a cube—i.e., all six faces are square in shape. In an alternate embodiment, the bottom support structure 100 is another geometric shape, e.g., a cylinder or polyhedron with an n-sided polygonal base. In one embodiment, one or more of the corners of a face are cut at an angle 130 or rounded.

An opening in an exterior top surface 105 of a bottom support structure 100 is defined by an interior cylindrical wall 110, an interior floor surface 115, and a raised cylinder 120 that extends upwards from the interior floor surface 115. The diameter of the interior floor surface 115, where the interior floor surface 115 meets the interior cylindrical wall 110, is wide enough to accommodate the exterior diameter of a beverage container within the opening. In one embodiment, the interior floor surface 115 has a diameter between 80 and 100 millimeters—e.g., 82.5 millimeters. The diameter of the raised cylinder 120 is smaller than the interior diameter of a beverage container, allowing the raised cylinder 120 to fit inside the opening of the beverage container. In one embodiment, the diameter of the raised cylinder 120 is between 60 and 80 millimeters—e.g., 65 millimeters.

In one embodiment, the raised cylinder 120 is ring-shaped, having a hollow center 135. For example, the floor of the hollow center 135 is at the same height from the bottom exterior surface of the bottom support structure 100 as the interior floor surface 115. In an alternate embodiment, the raised cylinder 120 is solid or includes a partially hollow center that has a floor at a different height than the interior floor surface 115.

In one embodiment, the opening includes a notched area 125 to accommodate a handle of or other protrusion (hereinafter collectively referred to as a handle) from a beverage container. An embodiment with a notch for a handle is configured to ship a beverage container or other vessel with a handle—e.g., a mug, a cup, glass, vase, or another vessel of a similar shape (collectively referred to herein as a beverage container). The notch 125 is an opening in, and radially projecting from, the interior cylindrical wall 110. In one embodiment, the notch 125 has a floor that is at the same height (from the bottom exterior surface of the bottom support structure 100) as the interior floor surface 115. Alternatively, the floor of the notch 125 is a different height than the interior floor surface 115 while maintaining enough depth from the exterior top surface 105 to accommodate the handle.

In one embodiment, the exterior top surface 105 of the bottom support structure 100 includes an elevated perimeter 140 which can be mated with a recessed perimeter of a top support structure, as will be described with further reference to FIGS. 10 and 11.

In one embodiment, the opening includes one or more notches 145 to reduce the amount of material required to create the bottom support structure 100. In one embodiment, the one or more notches 145 are configured to accommodate a finger to grip a side of a beverage container when the beverage container is inserted into the opening. The notch 145 is an opening in, and radially projecting from, the interior cylindrical wall 110. In one embodiment, the notch 145 has a floor that is at the same height as the interior floor surface 115. Alternatively, the floor of the notch 145 is a different height than the interior floor surface 115.

Figure 5:
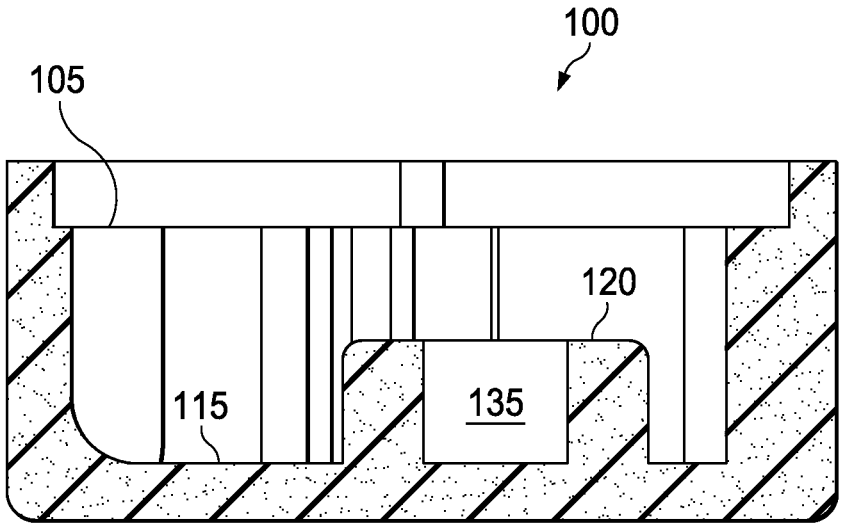
FIG. 5 shows a sectional view of bottom support structure of packaging according to one embodiment.

FIG. 5 shows a sectional view of bottom support structure 100 of packaging along the line labeled 5-5 in FIG. 2. This sectional view illustrates an embodiment in which the interior floor surface 115, the floor of the hollow center 135 of the raised cylinder 120, and the floor of the notch 125 are at the same height (e.g., from the bottom exterior surface of the bottom support structure 100). In one embodiment, the raised cylinder 120 is between 20 and 30 millimeters in height from the interior floor surface 115—e.g., 24.5 millimeters. In one embodiment, as discussed above, one or more of the interior floor surface 115, the floor of the hollow center 135, and the floor of the notch 125 may be at different heights. In one embodiment, the top exterior corner of the raised cylinder 120 is rounded. Alternatively, the top of the exterior corner of the raised cylinder 120 is a right angle.

Figure 6:
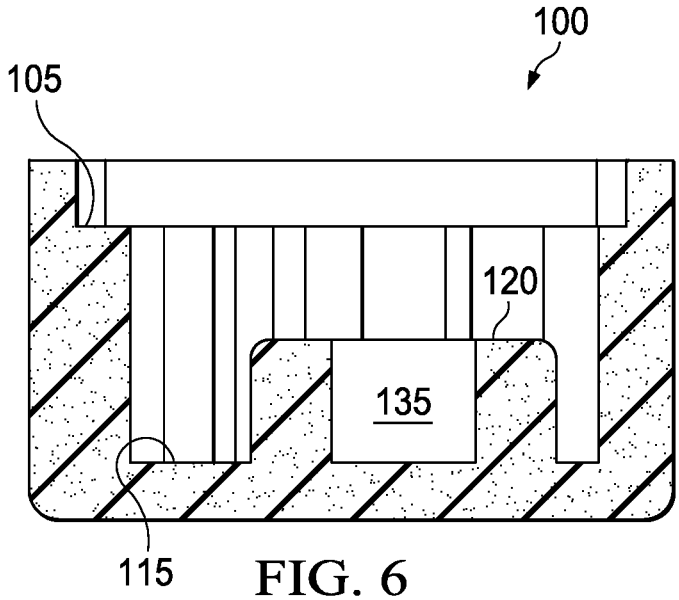
FIG. 6 shows another sectional view of bottom support structure of packaging according to one embodiment.

FIG. 6 shows another sectional view of bottom support structure 100 of packaging along the line labeled 6-6 in FIG. 3. This sectional view illustrates an embodiment in which the interior floor surface 115, the floor of the hollow center 135 of the raised cylinder 120, and the floor of the notch 145 are at the same height (e.g., from the bottom exterior surface of the bottom support structure 100). In one embodiment, one or more of the interior floor surface 115, the floor of the hollow center 135, and the floor of the notch 145 may be at different heights.

Figure 7:
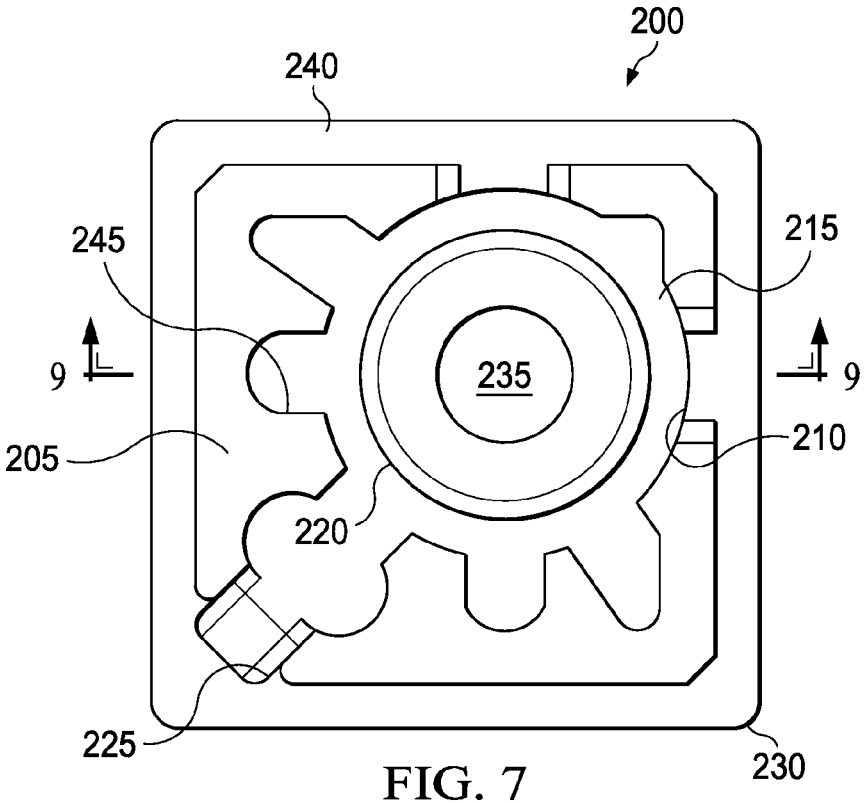
FIG. 7 shows a bottom view of a top support structure of packaging according to one embodiment.
Figure 8:
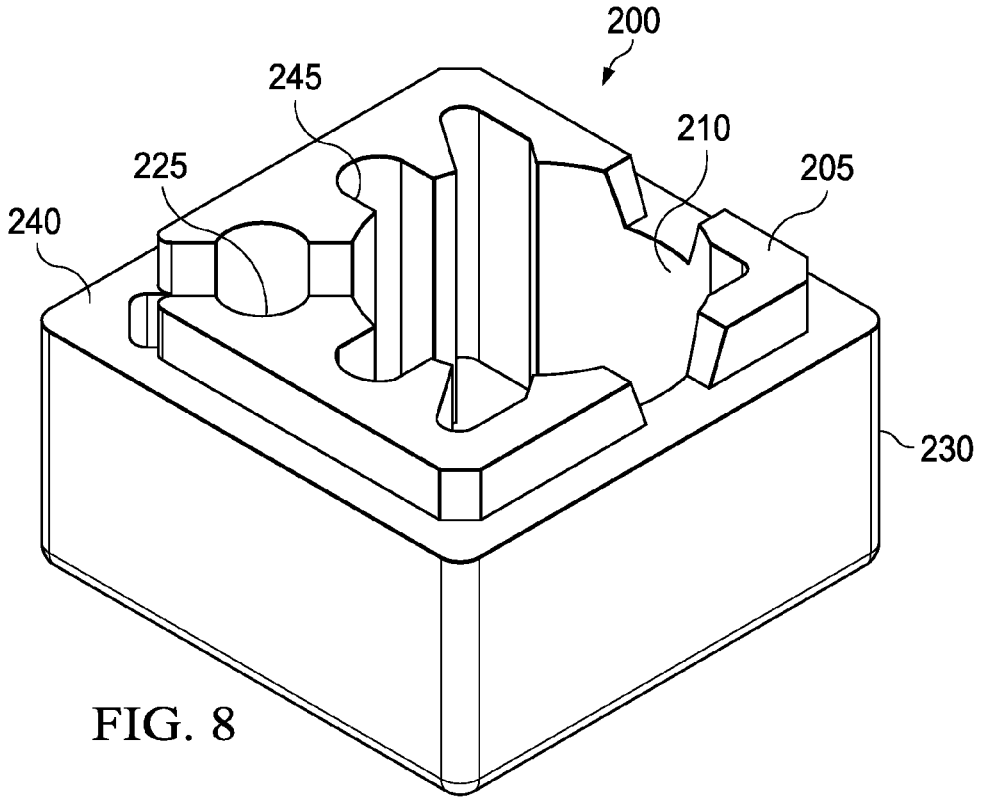
FIG. 8 shows a bottom and a side isometric view of a top support structure of packaging according to one embodiment.

FIG. 7 shows a bottom view and FIG. 8 shows a bottom and a side isometric view of a top support structure 200 of packaging according to one embodiment. In one embodiment, the top support structure 200 is a rectangular cuboid. In one embodiment, the cuboid is a square cuboid—i.e., at least two faces are square in shape. In one embodiment the top and bottom faces are square in shape. In one embodiment the sides of the squares that make up the top and bottom faces are between 130 and 140 millimeters in length, e.g., 136 millimeters in length. In one embodiment, the cuboid is a cube—i.e., all six faces are square in shape. In an alternate embodiment, the top support structure 200 is another geometric shape, e.g., a cylinder or polyhedron with an n-sided polygonal base. In one embodiment, one or more of the corners of a face are cut at an angle 230 or rounded.

An opening in an exterior bottom surface 205 of a top support structure 200 is defined by an interior cylindrical wall 210, an interior ceiling surface 215, and a raised cylinder 220 that extends downwards from the interior ceiling surface 215. The diameter of the interior ceiling surface 215, where the interior ceiling surface 215 meets the interior cylindrical wall 210, is wide enough to accommodate the exterior diameter of a beverage container within the opening. In one embodiment, the interior ceiling surface 215 has a diameter between 80 and 100 millimeters—e.g., 82.5 millimeters. The diameter of the raised cylinder 220 is smaller than the interior diameter of a beverage container, allowing the raised cylinder 220 to fit inside the opening of a beverage container. In one embodiment, the diameter of the raised cylinder 220 is between 60 and 80 millimeters—e.g., 65 millimeters. In an alternate embodiment, the top support structure 200 does not include a raised cylinder 220.

In one embodiment, the raised cylinder 220 is ring-shaped, having a hollow center 235. For example, the ceiling of the hollow center 235 is at the same height as the interior ceiling surface (e.g., said height being measured from the top exterior surface of the top support structure 200). In an alternate embodiment, the raised cylinder 220 is solid or includes a partially hollow center with a ceiling that is of a different height than the interior ceiling surface 215.

In one embodiment, the opening in the exterior bottom surface 205 of the top support structure 200 includes a notched area 225 to accommodate a handle of a beverage container. The notch 225 is an opening in, and radially projecting from, the interior cylindrical wall 210. In one embodiment, the ceiling of the notch 225 is at the same height as the interior ceiling surface 215 (e.g., said height being measured from the top exterior surface of the top support structure 200). Alternatively, the notch 225 is a different height than the interior ceiling surface 215 while maintaining enough depth from the exterior bottom surface 205 to accommodate the handle.

In one embodiment, the exterior bottom surface 205 of the top support structure 200 includes a recessed perimeter 240 in which the elevated perimeter 140 of the bottom support structure 100 can be placed, as will be described with further reference to FIGS. 10 and 11.

In one embodiment, the opening includes one or more notches 145 to reduce the amount of material required to create the packaging. In one embodiment, the one or more notches 145 are configured to accommodate a finger to grip a side of a beverage container when the beverage container is inserted into the opening.

In one embodiment, the opening in the exterior bottom surface 205 of the top support structure 200 includes one or more notches 245 to reduce the amount of material required to create the top support structure 200. In one embodiment, the one or more notches 245 are configured to accommodate a finger to grip a side of a beverage container when the beverage container is inserted into the opening. The notch 245 is an opening in, and radially projecting from, the interior cylindrical wall 210. In one embodiment, the notch 245 has a ceiling that is at the same height as the interior ceiling surface 215 (e.g., said height being measured from the top exterior surface of the top support structure 200). Alternatively, the ceiling of the notch 245 is a different height than the interior ceiling surface 215.

Figure 9:
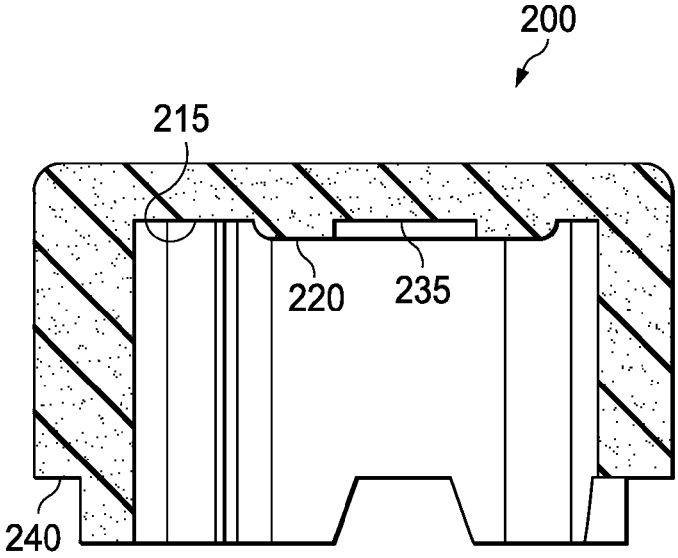
FIG. 9 shows a sectional view of a top support structure of packaging according to one embodiment.

FIG. 9 shows a sectional view of top support structure 200 of packaging along the line labeled 9-9 in FIG. 7. This sectional view illustrates an embodiment in which the interior ceiling surface 215, the ceiling of the hollow center 235 of the raised cylinder 220, and the ceiling of the notch 245 are at the same height (e.g., said height being measured from the top exterior surface of the top support structure 200). In one embodiment, one or more of the interior floor surface 215, the ceiling of the hollow center 235, and the ceiling of the notch 245 may be at different heights.

Figure 10:
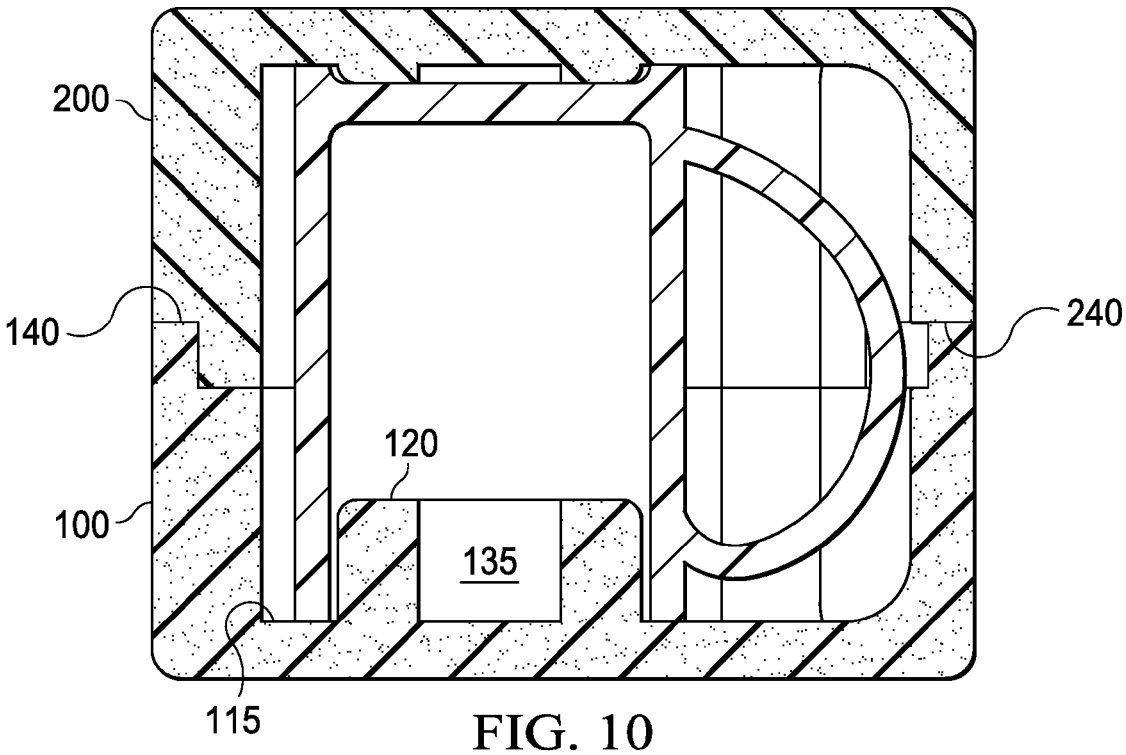
FIG. 10 shows a sectional view of bottom and top support structures of packaging enclosing a beverage container of a first height according to one embodiment.

FIG. 10 shows a sectional view of a bottom support structure 100 and a top support structure 200 of packaging enclosing a beverage container of a first height according to one embodiment. A beverage container of a first height fits within the opening in the bottom support structure 100 by placing an open side of the beverage container down upon the interior floor surface 115, the raised cylinder 120 extending into an interior of the beverage container of the first height. The solid bottom surface of the beverage container fits within the opening in the top support structure 200.

Figure 11:
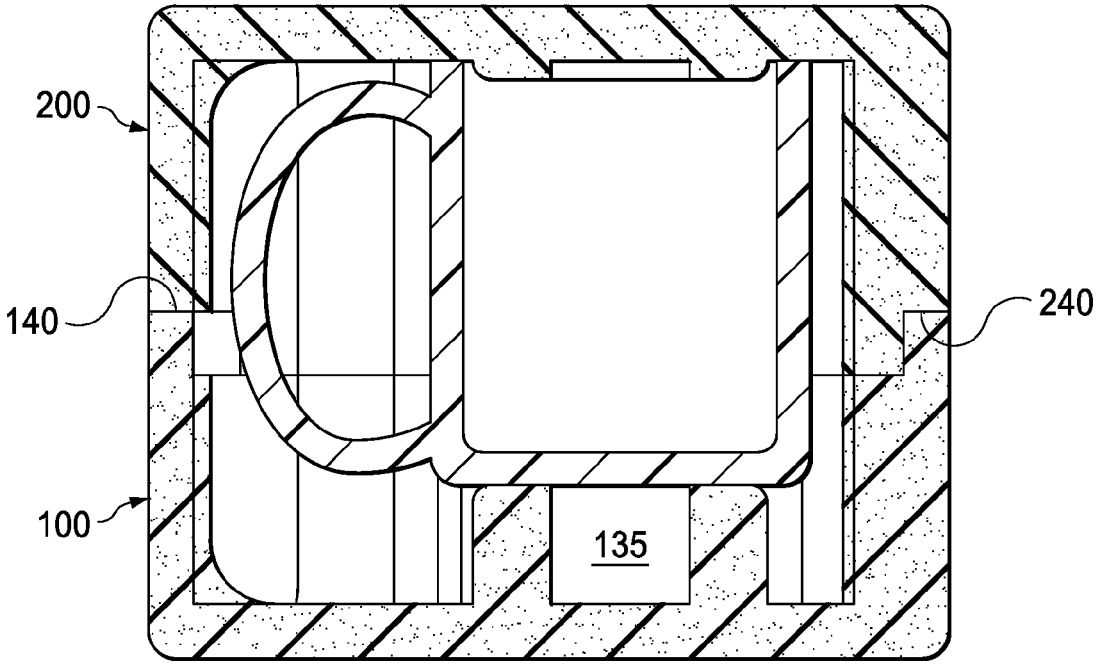
FIG. 11 shows a sectional view of bottom and top support structures of packaging enclosing a beverage container of a second height according to one embodiment.

FIG. 11 shows a sectional view of a bottom support structure 100 and a top support structure 200 of packaging enclosing a beverage container of a second height according to one embodiment. A beverage container of a second height fits within the opening in the bottom support structure 100 by placing a solid bottom surface of the beverage container of the second height down upon an upper surface of the raised cylinder 120. In one embodiment, the height of the raised cylinder 120 is equal to the difference in height between the first and second beverage containers. The open side of the beverage container fits within the opening in the top support structure 200.

In one embodiment, the recessed perimeter 240 of the top support structure 200 mates with the elevated perimeter 140 of the bottom support structure 100, as depicted in FIGS. 10 and 11. In an alternate embodiment, the bottom support structure 100 includes a recessed perimeter and the top support structure 200 includes an elevated perimeter.

The embodiments illustrated in FIGS. 10 and 11 depict the bottom support structure 100 and the top support structure 200 each receiving a portion of a beverage container in their respective openings. The depth of the openings in each of the bottom support structure 100 and the top support structure 200 may vary in correspondence with one another. For example, the greater the depth of the opening in the bottom support structure 100, the less depth is needed in the opening in the top support structure 200, and vice versa. Additionally, in one embodiment, the exterior heights of the bottom support structure 100 and the top support structure 200 share a similar inverse proportionality.

In one embodiment, the bottom support structure 100 includes an opening of a depth configured to receive the entire height of beverage containers of different heights. According to this embodiment, when the beverage container of the first height is placed with the open side of the beverage container down upon the interior floor surface 115, the raised cylinder 120 extends into the interior of the beverage container and the height of the exterior top surface 105 is equal to or greater than the height of the solid bottom of the beverage container from the interior floor surface 115. When the beverage container of the second height is placed with the solid bottom side of the beverage container down upon the raised cylinder 120, the height of the exterior top surface 105 is equal to or greater than the height of the top open side of the beverage container from the top of the raised cylinder 120.

Figure 12:
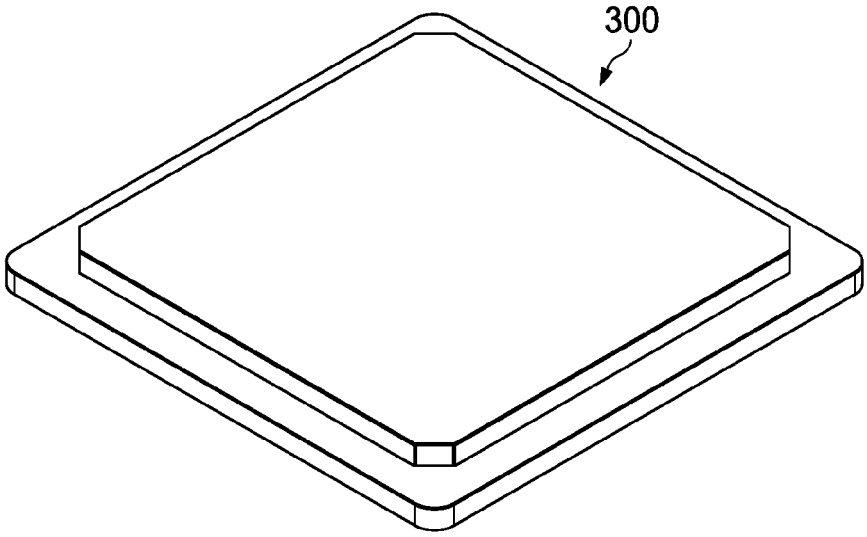
FIG. 12 shows a bottom and a side isometric view of a top support structure of packaging according to another embodiment.

FIG. 12 shows a bottom and a side isometric view of a top support structure 300 of packaging according an embodiment in which the bottom support structure includes an opening of a depth configured to receive the entire height of the beverage containers. The beverage containers of different heights are accommodated by the bottom support structure, so the top support structure 300 does not include an opening and serves solely as a lid for the opening in the bottom support structure. Similar to the top support structure 200 depicted in FIGS. 7-11, the top support structure 300 in FIG. 12 includes a recessed perimeter to mate with an elevated perimeter of a bottom support structure. In an alternate embodiment, the bottom support structure includes a recessed perimeter and the top support structure 300 includes an elevated perimeter.

Figure 13:
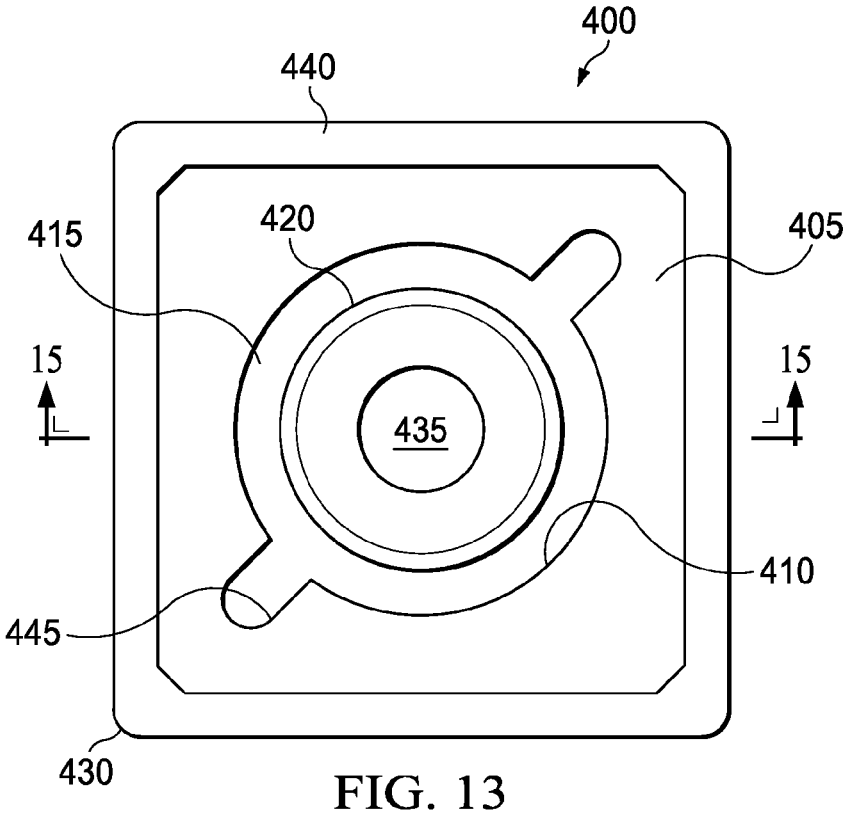
FIG. 13 shows a top view of a bottom support structure of packaging according to another embodiment.
Figure 14:
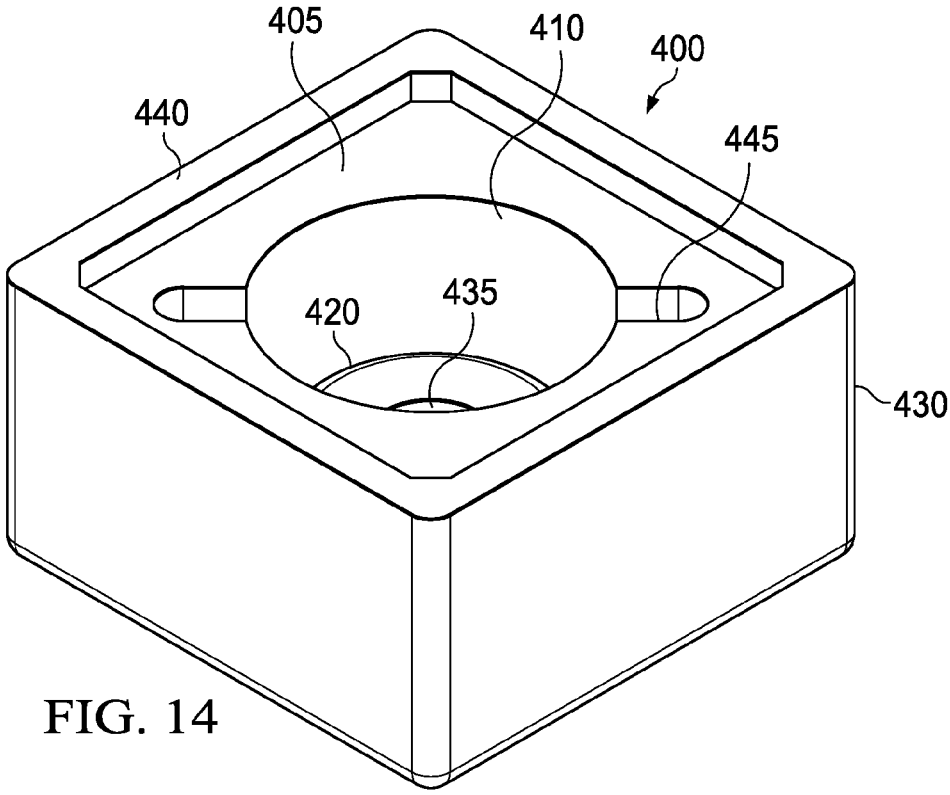
FIG. 14 shows a top and a side isometric view the bottom support structure of FIG. 13.

FIG. 13 shows a top view and FIG. 14 shows a top and a side isometric view of a bottom support structure 400 of packaging according to an embodiment without a notch for a beverage container handle. An embodiment without a notch for a beverage container handle is configured to ship a beverage container or other vessel without a handle—e.g., a cup, glass, vase, or another vessel of a similar shape (collectively referred to herein as a beverage container).

In one embodiment, the bottom support structure 400 is a rectangular cuboid. In one embodiment, the cuboid is a square cuboid—i.e., at least two faces are square in shape. In one embodiment the top and bottom faces are square in shape. In one embodiment the sides of the squares that make up the top and bottom faces are between 100 and 140 millimeters in length. In one embodiment, the cuboid is a cube—i.e., all six faces are square in shape. In an alternate embodiment, the bottom support structure 100 is another geometric shape, e.g., a cylinder or polyhedron with an n-sided polygonal base. In one embodiment, one or more of the corners of a face are cut at an angle 430 or rounded.

An opening in an exterior top surface 405 of a bottom support structure 400 is defined by an interior cylindrical wall 410, an interior floor surface 415, and a raised cylinder 420 that extends upwards from the interior floor surface 415. The diameter of the interior floor surface 415, where the interior floor surface 415 meets the interior cylindrical wall 410, is wide enough to accommodate the exterior diameter of a beverage container within the opening. In one embodiment, the interior floor surface 415 has a diameter between 80 and 100 millimeters—e.g., 82.5 millimeters. The diameter of the raised cylinder 420 is smaller than the interior diameter of a beverage container, allowing the raised cylinder 420 to fit inside the opening of the beverage container. In one embodiment, the diameter of the raised cylinder 420 is between 60 and 80 millimeters—e.g., 65 millimeters.

In one embodiment, the raised cylinder 420 is ring-shaped, having a hollow center 435. For example, the floor of the hollow center 435 is at the same height as the interior floor surface 415. In an alternate embodiment, the raised cylinder 420 is solid or includes a partially hollow center that has a floor at a different height than the interior floor surface 415. In one embodiment, the exterior top surface 405 of the bottom support structure 400 includes an elevated perimeter 440 to receive a top support structure.

In one embodiment, the opening in the bottom support structure 400 includes one or more notches 445 to reduce the amount of material required to create the bottom support structure 400. In one embodiment, the one or more notches 445 are configured to accommodate a finger to grip a side of a beverage container when the beverage container is inserted into the opening. The notch 445 is an opening in, and radially projecting from, the interior cylindrical wall 410. In one embodiment, the notch 445 has a floor that is at the same height as the interior floor surface 415 (said height measured from a bottom exterior surface of the bottom support structure 400). Alternatively, the floor of the notch 445 is a different height than the interior floor surface 415.

Figure 15:
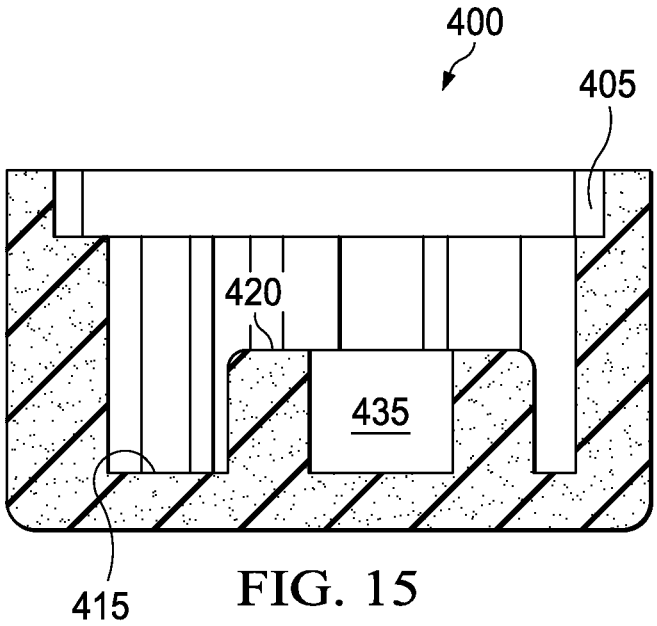
FIG. 15 shows a sectional view of the bottom support structure of FIG. 13.

FIG. 15 shows a sectional view of a bottom support structure 400 according to an embodiment without a notch for a beverage container handle along the line labeled 15-15 in FIG. 13. In one embodiment, the raised cylinder 420 is between 20 and 30 millimeters in height from the interior floor surface 415—e.g., 24.5 millimeters. In one embodiment, the top exterior corner of the raised cylinder 420 is rounded. Alternatively, the top of the exterior corner of the raised cylinder 420 is a right angle.

Figure 16:
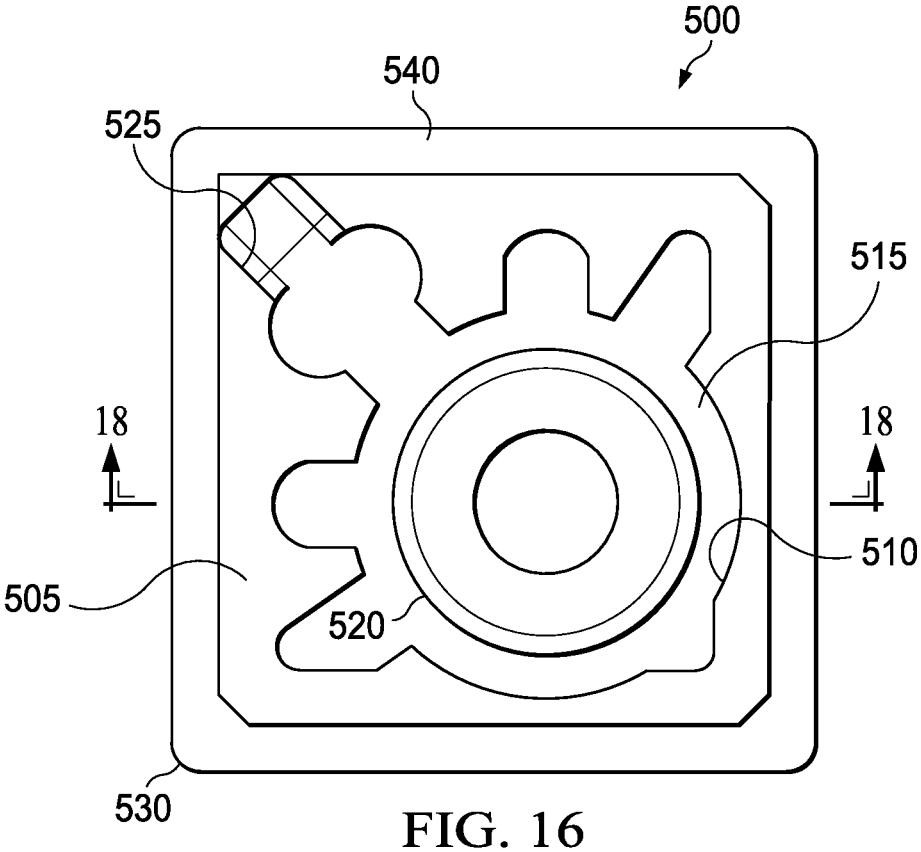
FIG. 16 shows a top view of a bottom support structure of packaging according to yet another embodiment.
Figure 17:
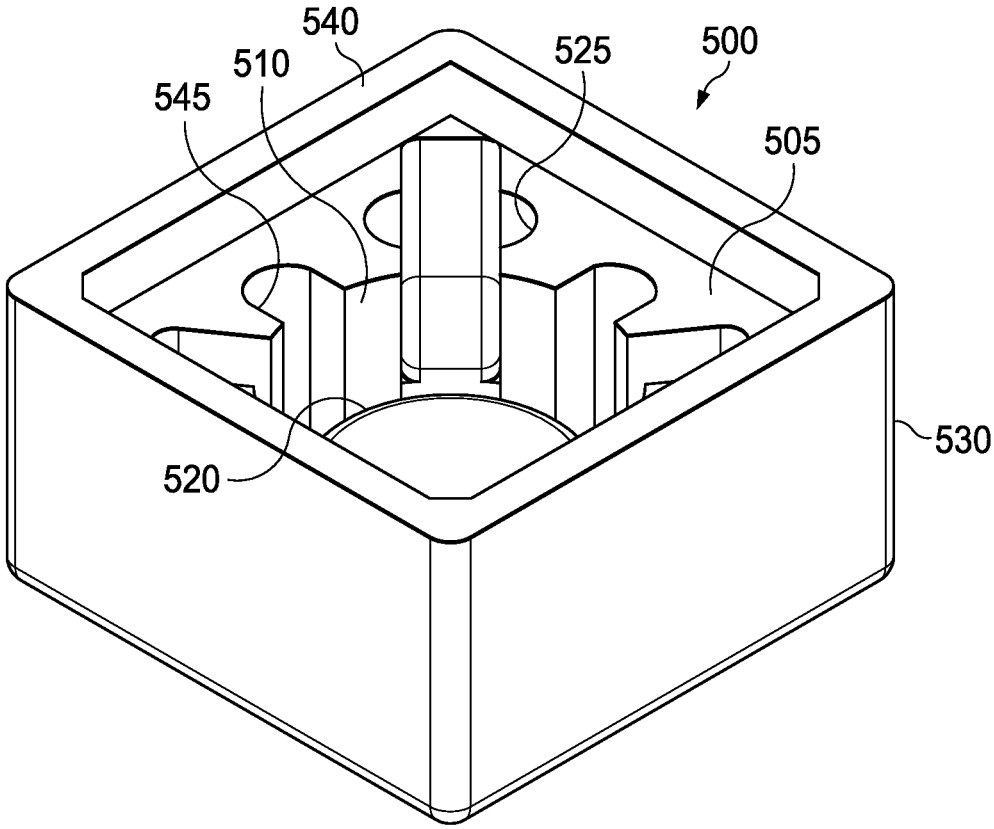
FIG. 17 shows a top and a side isometric view the bottom support structure of FIG. 16.

FIG. 16 shows a top view and FIG. 17 shows a top and a side isometric view of a bottom support structure 500 of packaging according to an embodiment that is similar to the embodiment described with reference to FIGS. 1-11, but in which an opening in an exterior top surface 505 of a bottom support structure 500 is defined by an interior cylindrical wall 510, an interior floor surface 515, and a truncated cone 520 that extends upwards from the interior floor surface 515. Similar to the elevated cylinder 120 described above, the truncated cone 520 is configured to fit within an opening within a beverage container. In one embodiment, the truncated cone 520 is solid. In an alternate embodiment, the truncated cone 520 is ring-shaped, having a hollow center 535, or includes a partially hollow center that has a floor at a different height than the interior floor surface 515. For example, the floor of the hollow center may be at the same height as the interior floor surface 515 (said height measured from a bottom exterior surface of the bottom support structure 500).

Figure 18:
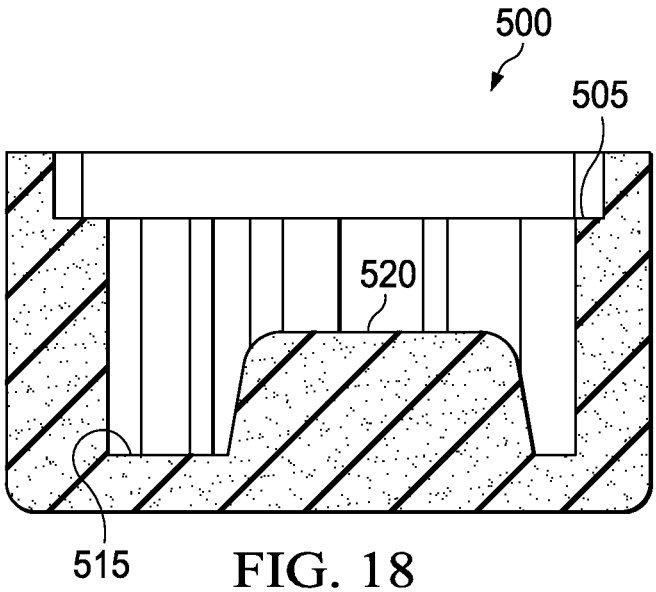
FIG. 18 shows a sectional view of the bottom support structure of FIG. 16.

FIG. 18 shows a sectional view of a bottom support structure of packaging according to an embodiment with a truncated cone 520 along the line labeled 18-18 in FIG. 16. In one embodiment, the truncated cone 520 is between 20 and 30 millimeters in height—e.g., 24.5 millimeters. This sectional view illustrates an embodiment in which the interior floor surface 515 and the floor of the notch 525 are at the same height. In one embodiment, one or more of the interior floor surface 515, the floor of the hollow center of the truncated cone 520, and the floor of the notch 525 may be at different heights. In one embodiment, the top exterior corner of the truncated cone 520 is rounded. Alternatively, the top of the exterior corner of the truncated cone 520 is a sharp angle.

Figure 19:
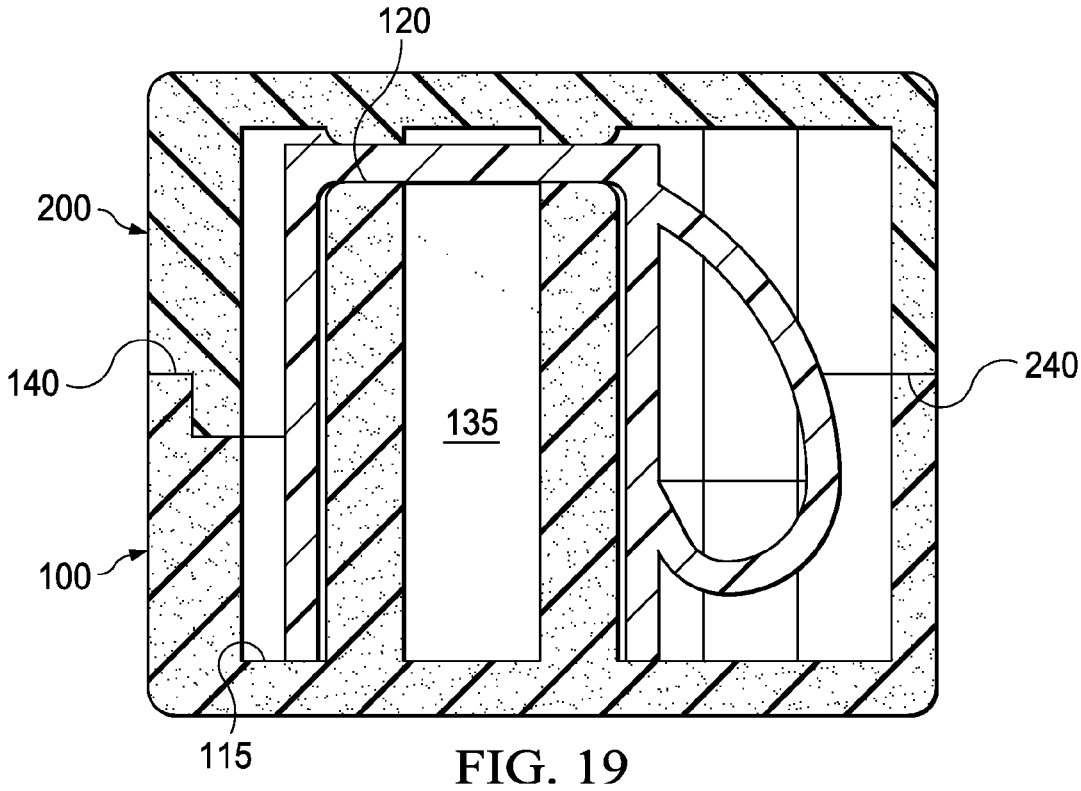
FIG. 19 shows a sectional view of bottom and top support structures of packaging enclosing a beverage container of a first height according to another embodiment.

FIG. 19 shows a sectional view of bottom support structure 100 and a top support structure 200 of packaging enclosing a beverage container of a first height according to another embodiment. A beverage container of a first height fits within the opening in the bottom support structure 100 by placing an open side of the beverage container down upon the interior floor surface 115, the raised cylinder 120 extending into an interior of the beverage container of the first height. The solid bottom surface of the beverage container fits within the opening in the top support structure 200.

Figure 20:
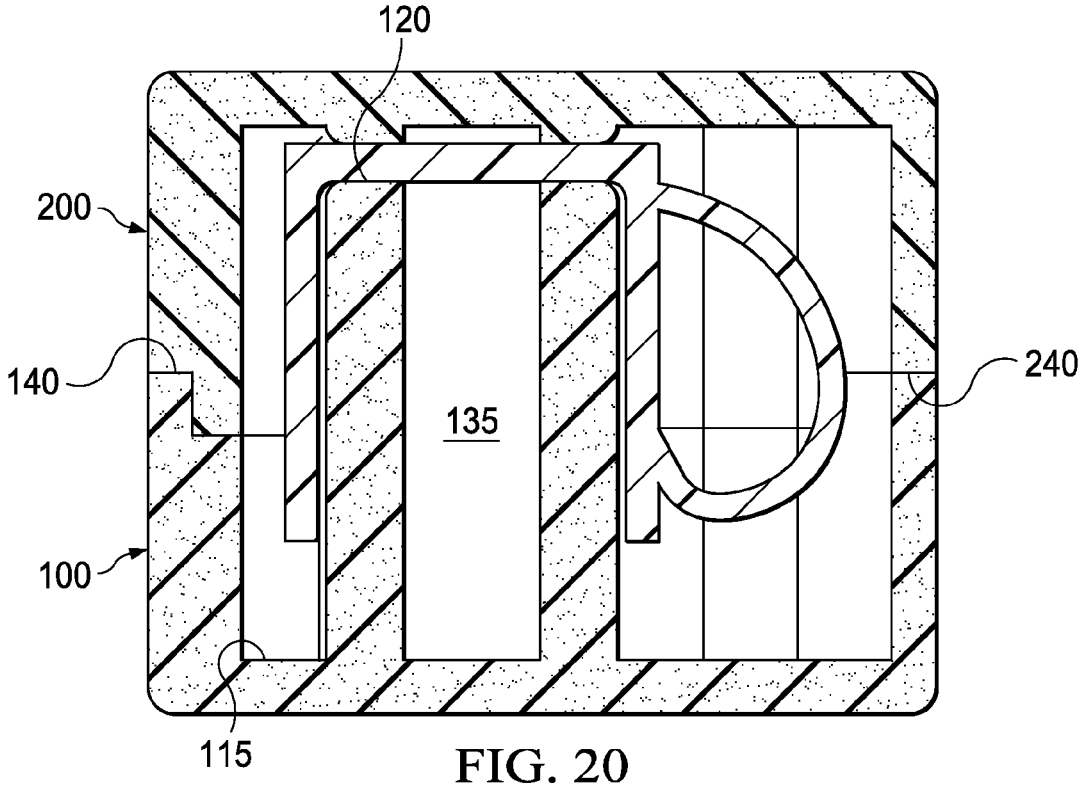
FIG. 20 shows a sectional view of bottom and top support structures of FIG. 19 enclosing a beverage container of a second height.

FIG. 20 shows a sectional view of bottom and top support structures of FIG. 19 enclosing a beverage container of a second height. Similar to FIG. 19, a beverage container of a second height fits within the opening in the bottom support structure 100 by placing an open side of the beverage container down upon the raised cylinder 120 and the solid bottom surface of the beverage container fits within the opening in the top support structure 200. In this embodiment, however, the raised cylinder 120 is of a height that is greater than the interior depth of the beverage container of a second height—e.g., greater than 65 millimeters in height from the interior floor surface 115. In one embodiment, the raised cylinder is between 80 and 120 millimeters in height. The beverage container of a second height (which is shorter than the first height), when positioned with the raised cylinder extending into the interior of the beverage container of a second height, does not reach the interior floor surface 115. In one embodiment, the height of the raised cylinder 120 is greater than the interior depth of the beverage container of a second height, e.g., equal in height to the interior depth of the beverage container of a first height.

As illustrated in FIGS. 19 and 20, the raised cylinder 120 extends beyond the exterior top surface 105 of the bottom support structure 100. Similar to the embodiments described above, the depth of the openings in each of the bottom support structure 100 and the top support structure 200 may vary in correspondence with one another. For example, the greater the depth of the opening in the bottom support structure 100, the less depth is needed in the opening in the top support structure 200, and vice versa. Additionally, in one embodiment, the exterior heights of the bottom support structure 100 and the top support structure 200 share a similar inverse proportionality.

For example, in one embodiment, the depth of the opening of the bottom support structure 100 is greater than the height of the raised cylinder 120 and the height of the raised cylinder 120 is greater than the interior depth of the beverage container of a second height. According to this embodiment, the raised cylinder 120 would not extend beyond the exterior top surface 105 of the bottom support structure 100. In such an embodiment, a top support structure 300, as illustrated in and described with reference to FIG. 12, would be used if the solid bottom of the beverage container(s) also does not extend beyond the exterior top surface 105 of the bottom support structure 100.

In the foregoing specification, the invention has been described with reference to specific exemplary embodiments thereof. It will be evident that various modifications may be made thereto without departing from the broader spirit and scope of the invention. The specification and drawings are, accordingly, to be regarded in an illustrative sense rather than a restrictive sense.

What is claimed is:

1. A system comprising:

a first beverage container having a first height; and a packaging apparatus to support the first beverage container or a second beverage container having a second height, the second height being less than the first height, the packaging apparatus comprising:

a bottom support structure including an opening having an interior floor surface and defining an interior wall within the opening, the interior floor surface having a first diameter; and a raised cylinder extending upwards from the interior floor surface, the raised cylinder having a base of a second diameter, wherein the first diameter is greater than the second diameter such that the first beverage container fits within the opening in the bottom support structure by placing an open side of the first beverage container down upon the interior floor surface, the raised cylinder extending in a similar direction as the interior wall and into an interior of the first beverage container, and the raised cylinder being of a height from the interior floor surface that is less than a height of the interior wall and such that the second beverage container fits within the opening in the bottom support structure by placing an exterior solid bottom surface of the second beverage container down upon an upper surface of the raised cylinder.

2. The apparatus of claim 1, wherein the opening further comprises a notched area to accommodate a handle of the first beverage container, the notched area radially projecting from the interior wall.

3. The apparatus of claim 1, wherein the height of the raised cylinder is equal to the difference between the first height and the second height.

4. The apparatus of claim 1, wherein the bottom support structure is a cuboid.

5. The apparatus of claim 1, wherein an exterior top surface of the bottom support structure includes an elevated perimeter onto which a recessed perimeter of a top support structure may be placed.

6. The apparatus of claim 1, further comprising a top support structure including an opening having an interior ceiling surface, the interior ceiling surface having a diameter equal to the first diameter of the bottom support structure.

7. The apparatus of claim 6, wherein the opening in the top support structure comprises a notched area to accommodate a handle of the first beverage container, the notched area radially projecting from an interior cylindrical wall of the top support structure.

8. The apparatus of claim 1, wherein the opening in the bottom support structure comprises a plurality of notched areas, the notched areas radially projecting from an interior cylindrical wall.

9. The apparatus of claim 1, wherein the height of the raised cylinder is between 20 and 30 millimeters.

10. The apparatus of claim 1, wherein the second diameter is between 60 and 80 millimeters.

* * * * *